US006160245A

United States Patent [19]

Broker et al.

[11] Patent Number: 6,160,245

[45] Date of Patent: Dec. 12, 2000

[54] VARIABLE VOLUME SIGNALING DEVICE FOR AN APPLIANCE

[75] Inventors: John F. Broker; Douglas W. Gardner, both of Newton, Iowa

[73] Assignee: Maytag Corporation, Newton, Iowa

[21] Appl. No.: 09/314,447

[22] Filed: May 19, 1999

[51] Int. Cl.[7] ..... H05B 1/02

[52] U.S. Cl. ..... 219/506; 219/412; 219/720; 219/494; 340/384.72; 340/392.3

[58] Field of Search ..... 219/506, 497, 219/492, 494, 720, 412–414; 307/117, 118; 340/384.1, 384.72, 392.3

[56] References Cited

U.S. PATENT DOCUMENTS

| | | | |
|---|---|---|---|
| 3,399,461 | 9/1968 | Doty . | |
| 3,739,299 | 6/1973 | Adler . | |
| 3,742,492 | 6/1973 | Proctor . | |
| 3,763,488 | 10/1973 | Klasing . | |
| 3,783,529 | 1/1974 | Miller et al. . | |
| 3,815,129 | 6/1974 | Sweany . | |
| 3,868,698 | 2/1975 | Dressler . | |
| 3,872,470 | 3/1975 | Hoerz et al. . | |
| 3,890,612 | 6/1975 | Sweany et al. . | |
| 3,912,952 | 10/1975 | Kumon et al. . | |
| 4,044,297 | 8/1977 | Nobue et al. . | |
| 4,104,628 | 8/1978 | Sweany et al. . | |
| 4,132,008 | 1/1979 | Deschaaf . | |
| 4,180,808 | 12/1979 | Lebet et al. . | |
| 4,237,448 | 12/1980 | Weinberg . | |
| 4,343,990 | 8/1982 | Ueda | 219/492 |
| 4,374,307 | 2/1983 | Haagan et al. . | |
| 4,393,373 | 7/1983 | Torii et al. . | |
| 4,486,742 | 12/1984 | Kudo et al. . | |
| 4,488,145 | 12/1984 | Katsuma et al. . | |
| 4,509,543 | 4/1985 | Livingston et al. . | |
| 4,520,576 | 6/1985 | Vander Molen . | |
| 4,567,806 | 2/1986 | Kodaira . | |
| 4,626,799 | 12/1986 | Matievic . | |
| 5,157,730 | 10/1992 | Liu . | |
| 5,303,371 | 4/1994 | Nakajima . | |
| 5,313,523 | 5/1994 | Kawauchi . | |
| 5,438,180 | 8/1995 | Eisenbrandt et al. | 219/492 |
| 5,467,077 | 11/1995 | Wunderlich et al. . | |
| 5,528,018 | 6/1996 | Burkett et al. . | |

FOREIGN PATENT DOCUMENTS

| | | |
|---|---|---|
| 25 42 849 | 3/1977 | Germany . |
| 63-203194 | 8/1988 | Japan . |
| 4-285999 | 10/1992 | Japan . |
| 6-71226 | 4/1994 | Japan . |

*Primary Examiner*—Mark Paschall
*Attorney, Agent, or Firm*—Everett G. Diederiks, Jr.

[57] ABSTRACT

An appliance is provided with a feedback system which audibly signals both the activation of user input controls and when the appliance reaches a certain operational stage. The system functions to adjust both of the feedback signals upon a single setting change made by a user, preferably at varying volume rates. In the preferred embodiment, the volume level for the operational stage signal is adjusted multiple times the volume level for the user input control signal as the setting is switched between any of low, medium and high settings.

27 Claims, 3 Drawing Sheets

VARIABLE VOLUME SIGNALING DEVICE FOR AN APPLIANCE

BACKGROUND OF THE INVENTION

1. Field of the Invention

The present invention pertains to the art of household appliances and, more particularly, to a variable volume signaling device for conveying to an operator of the appliance both the activation of user input controls and when the appliance reaches a predetermined operational stage.

2. Discussion of the Prior Art

Essentially all household appliances, including microwave ovens, ranges, dishwashers, washing machines, clothes dryers and the like, are provided with user input controls for use in selecting desired operating parameters of the appliances. For instance, a microwave oven generally incorporates an electronic keypad having both numeric and function control buttons which enable a user to select desired operation cycles, such as defrost or cooking cycles, and to also input activation time periods. Typically, a user would be provided with some type of feedback signal as a means of verifying when an engaged control button has been activated. Most commonly, an audible signal in the form of a short beep is produced to signify the pressing of each control button. In addition, it is common to signal the user when the selected operation cycle has been reached, such as an end of cycle feedback signal, by producing an audible signal which has a different tone, length or the like, as well as volume, from the key pressing signals. In the case of a microwave oven, this signaling generally takes the form of a series of louder beeps. In other types of appliances, such as clothes dryers, buzzers or tone generators are commonly utilized for this purpose.

Regardless of the type of audible signal produced, it is often desirable to adjust the volume level associated with such a signaling system. In certain appliance models, provisions are made for controlling the volume level of the signal indicating when a certain operational stage, such as an end of cycle condition, has been reached. However, it can also be desirable to vary the volume of the signals generated upon use of the keypad. Since the user will be situated at the appliance when inputting the desired cycle parameters and will generally be remote from the appliance when the cycle condition is reached, adjusting these volume levels evenly could result in the user being subjected to a somewhat ear splitting sound while operating the keypad. For at least this reason, audible signaling systems of the type described will generally have fixed volume signaling for the operation of the control pad, while some enable variances in the volume output for the operational stage signals. Although it would be possible to provide separate user input and operational stage signaling systems, each incorporating its own volume adjusting circuitry, such an arrangement would unduly add to the cost and complexity of the overall appliance.

Based on the above, there exists a need in the art of appliances for a signaling system which produces audible signals upon both the activation of user input controls and when the appliance reaches a certain operational stage, wherein the volume levels associated with each of the signals can be simultaneously adjusted at varying increments or rates.

SUMMARY OF THE INVENTION

An appliance constructed in accordance with the present invention incorporates a system for providing a first audible feedback signal to a user when input controls are manually activated and a second audible feedback signal when the appliance reaches a predetermined operational stage. The system is designed so that a single volume control change functions to adjust the volume levels of both the first and second audible feedback signals, with the volume level adjustments being automatically made, preferably at varying increments or rates.

Although essentially infinite volume levels could be developed between established high and low settings, in a preferred form of the invention, four predetermined sets of volume levels are available. More specifically, the audible signaling system can be turned off or placed in any one of low, medium or high settings. In the off position, no audible signals are produced. In the low setting, rather moderate signals, such as 40 dB for the first audible feedback signal and 45 dB for the second audible feedback signal, would be produced. When the system is changed to the medium setting, the volume for each of the first and second audible feedback signals is automatically increased, but at varying increments or rates. For example, the first audible feedback signal would be increased a few decibels to, for instance, 43 dB, while the second audible feedback signal is increased to a much greater extent, for instance, to 51 dB. A similar step increase is made for each of the volume levels when the high setting is chosen. For example, the first audible feedback signal could increase to 46 dB, while the second audible feedback signal would jump to a much higher level, such as 63 dB. In any case, the established volume adjustment range for the first audible feedback signal would be less than the range associated with the second audible feedback signal, yet both signals would be systematically controlled based on a selected user setting.

With this system, even when the user desires the high level setting for the second audible signal, he or she would still experience a comfortable volume level when setting the input controls such that the user would be spared the ear splitting high decibel range established for the high second audible feedback signal when operating the input controls. Therefore, the system provides an integrated volume control arrangement which enables a single operator control to be used to adjust, at varying rates, multiple feedback signal volume levels simultaneously. The overall system can be advantageously used to selectively establish appropriate signal settings based on numerous factors, such as varying hearing capabilities between consumers, the location of the appliance in a particular home or simply the personal preferences between different appliance users.

Additional objects, features and advantages of the present invention will become more readily apparent from the following detailed description of a preferred embodiment when taken in conjunction with the drawings wherein like reference numerals refer to corresponding parts.

DETAILED DESCRIPTION OF THE PREFERRED EMBODIMENTS

Figure 1:
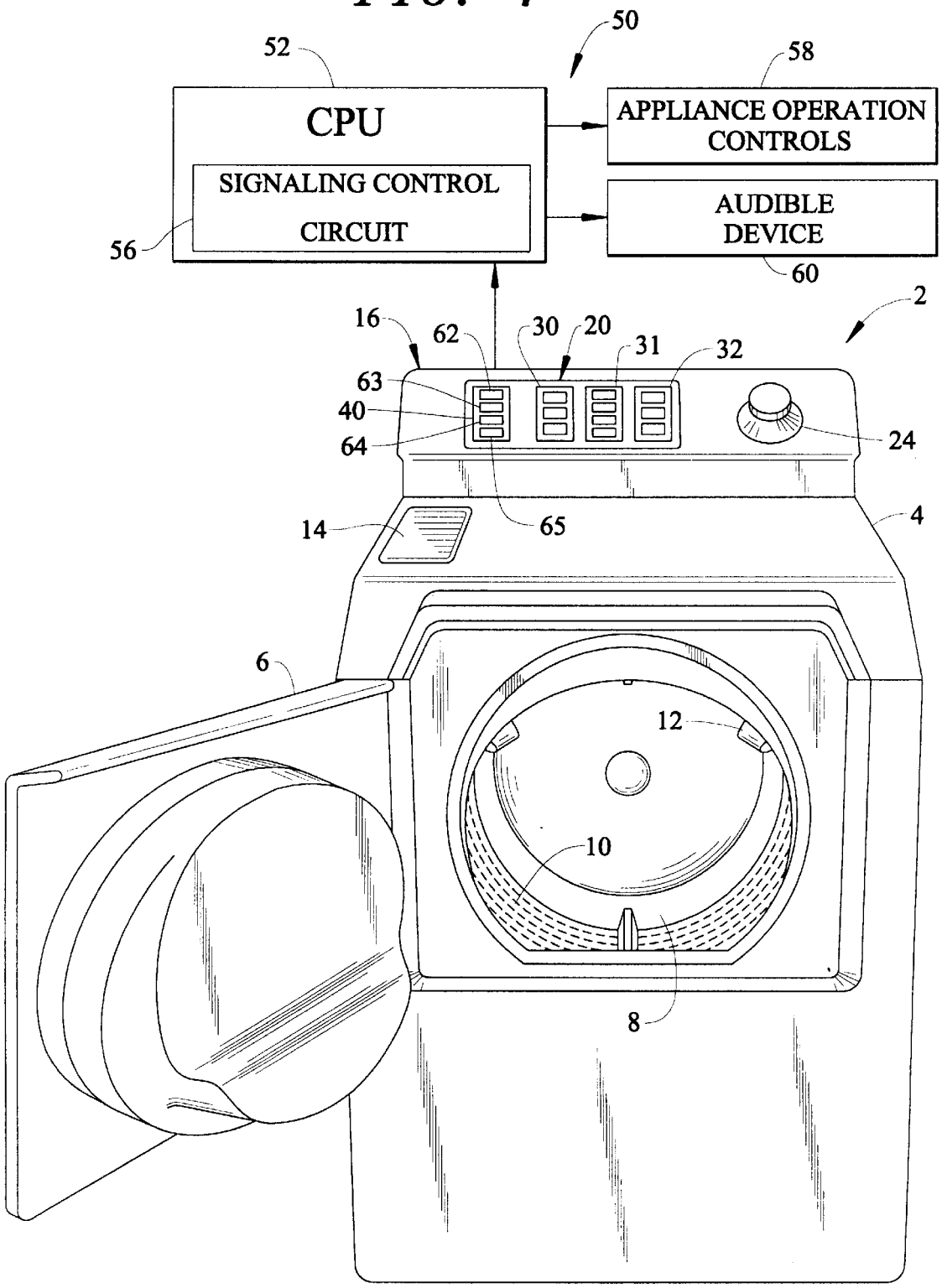
FIG. 1 is a front perspective view of a washing machine incorporating the variable volume signaling system of the invention.

For exemplary purposes, the invention will be described for use in connection with a washing machine as generally shown at 2 in FIG. 1. However, it should be initially understood that the invention is equally applicable to various other types of appliances, including, but not limited to, microwave ovens, dishwashers, ranges, clothes dryers and various other common household units. As shown in FIG. 1, washing machine 2 includes an outer cabinet shell 4 having an associated door 6 which can be selectively opened to expose a washing basket 8. In the embodiment shown, washing basket 8 is mounted within outer cabinet shell 4 for rotation about an axis which is angled slightly downward and rearward. For the sake of completeness, washing basket 8 is shown to include a plurality of holes 10, as well as various annularly spaced and radially inwardly projecting fins or blades 12 which are fixedly secured to washing basket 8. In a manner known in the art, washing basket 8 is adapted to rotate during both wash and rinse cycles such that articles of clothing placed therein actually tumble through either a water/detergent solution or water supplied within washing basket 8. Of course, washing basket 8 is adapted to be driven by a motor (not shown), with the motor preferably being constituted by a variable speed, reversible electric motor. Washing machine 2 is also shown to include an upper cover 14 that provides access to an area for adding detergent, softeners and the like.

More pertinent to the present invention, washing machine 2 is shown to incorporate an upper control panel 16. In the preferred embodiment shown, control panel 16 includes a keypad, generally indicated at 20, and a rotary control knob 24. Keypad 20 and control knob 24 are utilized to manually establish a desired washing operation, with each of keypad 20 and control knob 24 being used to manually set certain cycle parameters of washing machine 2. For instance, keypad 20 is shown to include a section 30 used for setting a desired fill level for a given washing operation, a section 31 for use in establishing desired wash and rinse water temperatures and a section 32 for establishing a desired type of washing operation, such as gentle, normal or the like, typically based on particular fabrics being washed. On the other hand, control knob 24 is used to set the type and duration of the washing operation.

Although control panel 16 is shown to include keypad 20 and control knob 24, it should be understood that these particular types of control elements are merely intended to be exemplary and that other types of control elements, including manual switches or rotary knobs could be readily utilized. In accordance with the present invention, keypad 20 also includes a section 40 for use in establishing feedback sound levels provided to a user upon both the activation of the user input controls of keypad 20 and when washing machine 2 reaches a predetermined operational stage, such as an end of cycle condition. Keypad 20 and rotary control knob 24 form part of an overall appliance control system generally indicated at 50. Control system 50 includes a CPU 52 which incorporates a signaling control circuit 56 to which section 40 of keypad 20 is linked. CPU 52 controls the operation of the appliance by outputting signals to a wash and rinse cycle control module 58 and also to an audible feedback device 60, such as a buzzer or other type of tone generator. The present invention is particularly directed to the manner in which the settings established at section 40 of keypad 20 are processed by signaling control circuit 56 to establish variable volume outputs for audible feedback device 60 as will now be described in detail.

In the most preferred form of the invention, section 40 of keypad 20 includes four buttons 62–65 which can be used to manually select between off, low, medium and high volume feedback levels respectively. In accordance with the invention, the pressing of any one of buttons 62–65 functions to automatically set the volumes of both a first audible signal which provides the user with immediate feedback that a selected control panel button has been depressed and a second audible feedback signal used to indicate that an operational stage, such as the end of a cycle or a time to add bleach or fabric softener, of washing machine 2 has been reached. At this point, it should be recognized that the function of buttons 62–65 could be performed in various ways without departing from the spirit of the invention. For instance, a rotary knob or other type of signal level selector element could also be employed to switch between the multiple feedback settings. In addition, the actual number of volume settings could also be changed so long as at least two distinct signaling levels are provided.

In the embodiment shown, button 62 is used to turn off audible feedback device 60. That is, if no audible feedback signals are desired by the user, button 62 would be activated to send a signal to signaling control circuit 56 to cancel all outputs to audible feedback device 60. If button 63 is selected, rather low first and second feedback volumes would be established. For instance, the volume level associated with the first audible feedback signal would be set at approximately 40 dB, while the volume level for the second audible feedback signal would be set at approximately 45 dB. Therefore, the activation of any user input control on keypad 20 would be reflected by a tone or beep being produced in the order of 40 dB. On the other hand, when washing machine 2 reaches, for example, the end of a cycle, a 45 dB signal would be developed. Preferably, the second audible feedback signal would not only differ from the first audible feedback signal in volume, but also in duration and style.

If the user selects the medium level signaling button 64, the volume levels associated with each of the first and second audible feedback signals would be automatically adjusted, but at varying rates. For instance, the first audible feedback signal would be moderately increased a few decibels, e.g., to 43 dB, while the second audible feedback signal would be further increased, such as to 51 dB, by signaling control circuit 56. Finally, if the user selects the high level signaling button 65, the first audible feedback signal would again moderately increase to, for instance, 46 dB. At the same time, the second audible feedback signal volume would jump to a rather high level, such as in the order of 63 dB.

With this system, even when the user desires the high level setting for the second audible signal, he or she would still experience a comfortable volume level when setting the input controls. In any event, the system provides an integrated volume control arrangement which enables a single operator control to be used to adjust, at varying rates, multiple feedback signal volume levels simultaneously. The overall system can be advantageously used to selectively establish appropriate signal settings based on numerous factors, such as varying hearing capabilities between consumers, the location of the appliance in a particular home or simply the personal preference between different appliance users.

In the preferred embodiment described, the pre-established volume settings are simply stored in CPU 52. However, CPU 52 can be provided with suitable logic that would provide an essentially infinite number of settings. In this situation, the volume setting for the second audible feedback signal would simply be determined from a mathematical formula or preset curve that would adjust the second audible feedback signal at a different rate than the first audible feedback signal. In any case, it is preferable to have the second audible feedback signal increase at a rate which is multiple times greater than the incremental increase for the first audible feedback signal as the volume is adjusted from low to high. In the example provided, as the first audible feedback signal is increased 3 dB, i.e., from 40 dB to 43 dB, the second audible feedback is increase double, i.e., 6 dB or from 45 dB to 51 dB. When the first audible feedback signal is increased to high, another 3 dB increase is made, whereas the second audible feedback signal is increase four times this amount. Therefore, it is preferable in accordance with the invention to actually alter the second audible feedback signal multiple times the volume amount established for the first audible feedback signal when the signaling system is changed between its settings.

Figure 2:
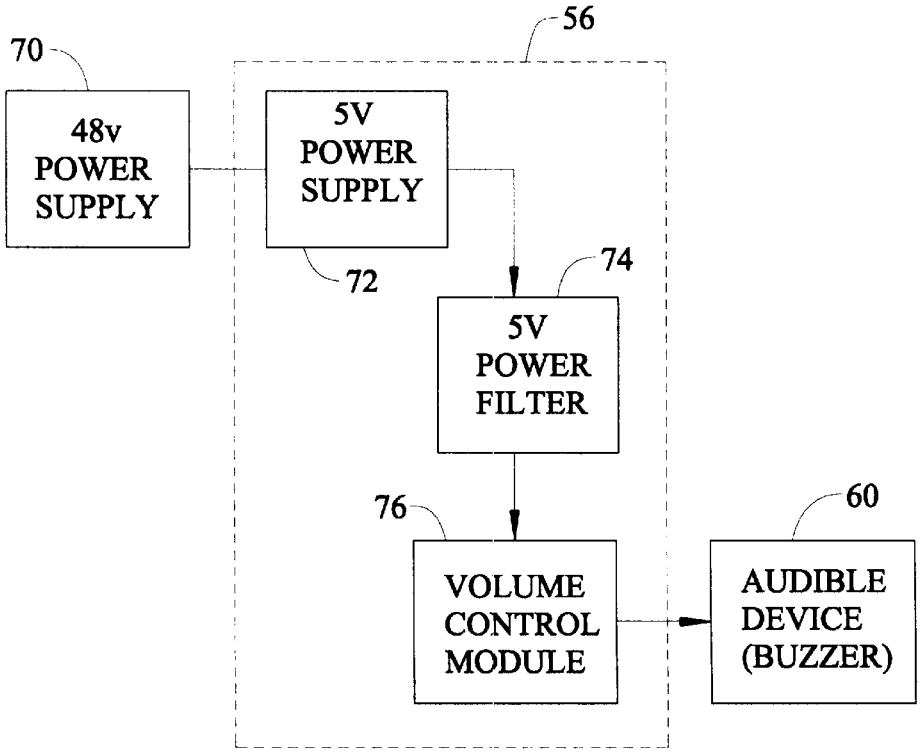
FIG. 2 is a block diagram of an exemplary signaling control system for use in the invention.

Although there are various ways to accomplish the variable volume aspect of the invention, it is preferable, as illustrated in FIG. 2, to step down an available 48 volt power supply 70 within washing machine 2 to create a 5 volt supply 72 which is filtered at 74 and delivered to a volume control module 76, such as a MOTOROLA 6805 uP chip. Module 76 then establishes the output frequency to audible device 60 based on its pre-programming and the user selected control inputs. It should be realized that the particular circuitry components utilized can greatly vary without departing from the invention and designing different circuitry to perform the same function is well within the skill of an ordinary artisan. However, for the sake of completeness, three possible circuit arrangements for audible device 60 and control module 76 will be described below with particular reference to FIGS. 3–5 wherein like reference numeral refer to corresponding components.

Initially, it should be noted that, in the most preferred form, audible device 60 is constituted by a piezoelectric device. In general, such sound producing devices are formed from complex crystals or ceramics which have the property of changing their dimensions in response to having a voltage placed across them. As such, they will vibrate when placed in an alternating voltage and, if the voltage is within a predefined range, an audible sound will be produced. Such devices are commonly used as buzzers, loudspeakers and the like, with an audible range roughly between 100 Hz to about 15,000 Hz, but preferably between 1,000 Hz to 10,000 Hz.

An important feature of piezoelectric devices is that they are self-resonant, i.e., they possess a natural electromechanical frequency at which they are most efficient. At frequencies above and below the resonant frequency, their sound producing efficiency falls off. The resonant frequency can be shifted by putting a reactive component, such as a capacitor, across the device. Also, the peak associated with the device can be broadened, at some loss to its efficiency, by putting a resistor across the piezoelectric crystal. In accordance with the embodiment illustrated in FIG. 3, capacitor C1 and resistor R2 are provided for these purposes. Resistors R1 and R3 are provided to match the requirements of transistor driver Q1. Here, the chip of volume control module 76 generally functions to as a square wave generator. In this embodiment, audible device 60 has a resonant frequency of 2700 Hz which will produce a rather high pitched buzzing noise. The frequency can be adjusted to vary the volume of audible device 60, e.g., to 2300 Hz for a low output.

Figure 3:
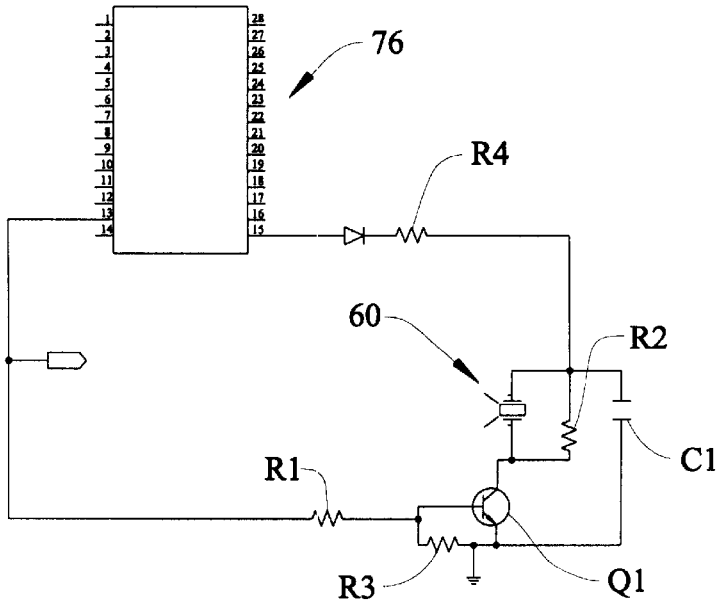
FIG. 3 shows an electric circuit which forms part of the signaling control system in accordance with a first embodiment of the invention.

FIG. 3 is provided to illustrate the use of pulse width modulation (PWM) to vary the volume output. This embodiment is based on providing a constant frequency signal at the speaker output while varying the ON/OFF ratio of the pulse width modulation output signal. That is, the longer the "ON" time and the shorter the "OFF" time, the higher the average voltage developed. Therefore, the square wave produced will vary in form to develop high-to-low duty cycles. When the duty cycle is higher, more power is delivered to audible device 60 to develop a louder sound. Here, volume control module 76 is used to create the cycle variations.

Figure 4:
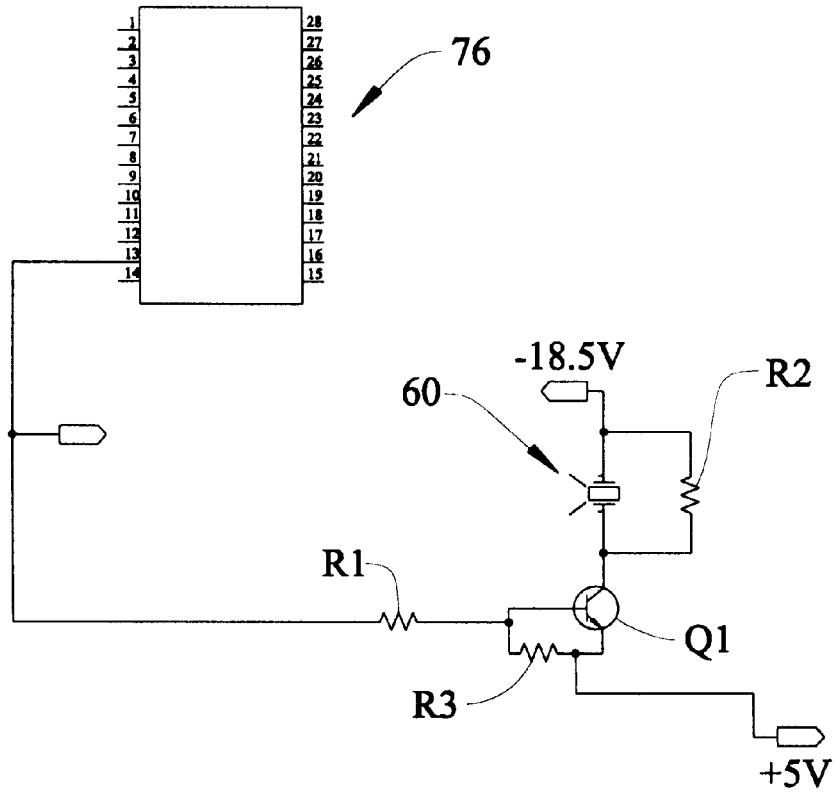
FIG. 4 shows an electric circuit which forms part of the signaling control system in accordance with a second embodiment.

As illustrated in the variable frequency circuit of FIG. 4, pin 13 of volume control module 76 drives Q1 "ON" when the voltage is at zero or close to common. This applies a positive voltage to one side (pin 1) of audible device 60. When pin 13 is high, i.e., at a voltage close to +5 Volts with respect to common, Q1 is "OFF" and pin 1 of audible device 60 is pulled down to −18.5 Volts by R2. Therefore, this circuit arrangement allows audible device 60 to see a signal near 24 Volts peak to peak from volume control module 76 which, in turn, is only operating with the 5 Volt input. In any event, this embodiment teaches one way in which the volume associated with audible device 60 can be varied through frequency changes. In other words, the loudest signal is developed at the resonance frequency of audible device 60 and lower volumes are simply established by altering this frequency.

Figure 5:
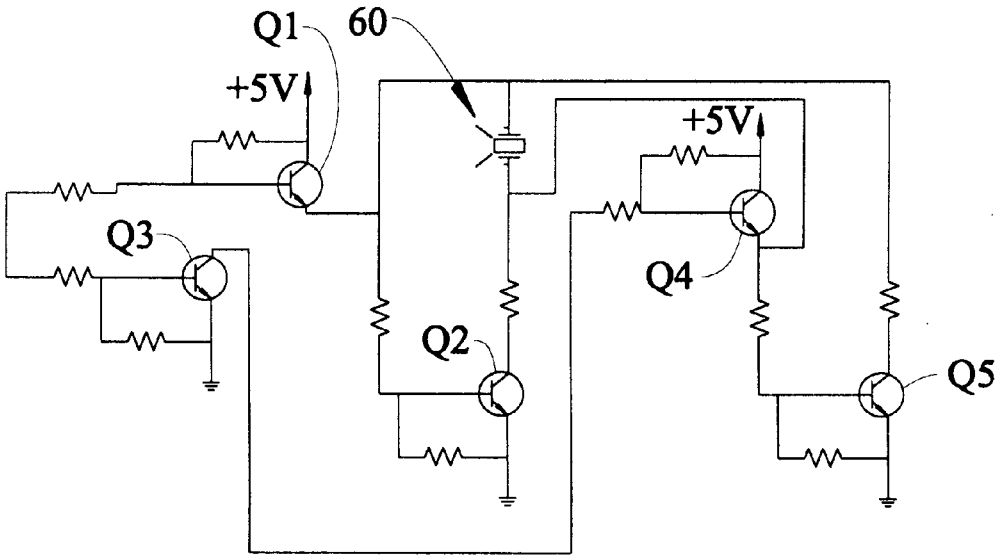
FIG. 5 shows an electric circuit which forms part of the signaling control system in accordance with a third embodiment.

In the embodiment of FIG. 5, the power to audible device 60 is increased by increasing the-amplitude of the AC voltage without increasing the DC voltage. This function is performed through the use of an AC voltage doubler circuit. In the embodiment shown, amplifiers Q1 and Q3 are driven by an AC voltage input. These amplifiers are essentially driven in parallel, with their outputs being in phase, i.e., the amplifiers are in synchronism. In order to effectively double the output voltage to audible signaling device 60, amplifiers Q1 and Q3 must be placed out of phase with one another so that when voltage to one is increasing, the voltage to the other is decreasing. The output of amplifier Q1 goes through Q2 and then to audible device 60. However, the output of amplifier Q3 leads to an inverter Q4, which changes the voltage signal 180°, and then to audible device 60 through Q5. With this arrangement, the outputs of Q2 and Q5 are out of phase such that their outputs are effectively summed to produce twice the AC change in voltage. This higher voltage is used to drive audible device 60 at the higher output level.

Based on the above, it should be readily apparent that the varying volume output required for the present invention can be developed in a number of ways. Therefore, although described with reference to preferred embodiments, it should be readily apparent that there exist numerous ways to accomplish the invention without departing from the spirit thereof. In any event, it is to be understood that the above invention description is intended to be illustrative and not restrictive, such that the invention can be utilized in connection with various types of known appliances and should only be limited by the scope of the following claims.

What is claimed is:

1. An appliance comprising:

a control panel including user input controls for establishing a desired operation of the appliance, with the desired operation having an associated operational stage;

a device for outputting audible signals upon both an activation of the user input controls and when the appliance reaches the operational stage, said device being adapted to output a first audible signal upon the activation of the user input controls and a second audible signal when the appliance reaches the operational stage; and a control system for selectively adjusting volume levels of the first and second audible signals.

2. The appliance according to claim 1, wherein the control system adjusts the volume levels of the first and second audible signals at varying rates.

3. The appliance according to claim 1, wherein the control system includes at least one manual signal level selector which can be selectively controlled by a user to simultaneously adjust the volume levels of both the first and second audible signals.

4. The appliance according to claim 3, wherein the at least one signal level selector has multiple volume establishing positions.

5. The appliance according to claim 4, wherein the volume level of the second audible signal is adjusted multiple times the volume level of the first audible signal through each of the multiple volume establishing positions.

6. The appliance according to claim 5, wherein the multiple volume establishing positions include low, medium and high settings.

7. The appliance according to claim 1, wherein the volume level of the second audible signal has a low to high sound range which is multiple times greater than a low to high sound range for the first audible signal.

8. The appliance according to claim 7, wherein the low to high sound range of the second audible signal is at least three times the low to high sound range of the first audible signal.

9. The appliance according to claim 1, wherein the control system includes frequency altering means for adjusting the volume levels.

10. The appliance according to claim 1, wherein the control system includes pulse width modulation circuitry for adjusting the volume levels.

11. The appliance according to claim 1, wherein the control system includes voltage doubling means for adjusting the volume levels.

12. An appliance comprising:

a control panel including user input controls for establishing a desired operation of the appliance, with the desired operation having an associated operational stage;

means for outputting audible signals upon both an activation of the user input controls and when the appliance reaches the operational stage, said outputting means being adapted to output a first audible signal upon the activation of the user input controls and a second audible signal when the appliance reaches the operational stage; and means for simultaneously adjusting each of the first and second audible signals between low and high volume levels, wherein the volume level of the second audible signal has a low to high range which is multiple times greater than a low to high sound range of the first audible signal.

13. The appliance according to claim 12, wherein the low to high sound range of each of the first and second audible signals includes low, medium and high settings.

14. The appliance according to claim 12, wherein the adjusting means includes a manual signal level selector which can be selectively controlled by a user to simultaneously adjust the volume levels of both the first and second audible signals.

15. The appliance according to claim 14, wherein the manual signal level selector has multiple volume establishing positions.

16. The appliance according to claim 15, wherein the volume levels of the first and second audible signals are adjusted at varying rates.

17. The appliance according to claim 15, wherein the multiple volume establishing positions include low, medium and high settings.

18. The appliance according to claim 12, wherein said adjusting means includes frequency altering means for adjusting the volume levels.

19. The appliance according to claim 12, wherein said adjusting means includes pulse width modulation circuitry for adjusting the volume levels.

20. The appliance according to claim 12, wherein said adjusting means includes voltage doubling means for adjusting the volume levels.

21. A method of simultaneously controlling the audible signaling of both an activation of user input controls and an operational stage of an appliance comprising:

selectively changing the audible signaling from a first setting to a second setting; and automatically adjusting a volume level for the audible signaling of the operational stage to a greater extent than a volume level for the audible signaling of the activation of the user input controls upon changing from the first setting to the second setting.

22. The method according to claim 21, further comprising: changing between the first and second settings through the manual operation of a signal level selector.

23. The method according to claim 21, further comprising:

adjusting the volume for the audible signaling of the operational stage multiple times the volume for the audible signaling of the activation of the user input controls upon changing from the first setting to the second setting.

24. The method according to claim 21, further comprising: changing the audible signal by selecting between at least off, low, medium and high settings.

25. The method according to claim 21, further comprising: adjusting the volume levels by altering a voltage frequency delivered to an audible device.

26. The method according to claim 21, further comprising: adjusting the volume levels by controlling a pulse width modulation signal delivered to an audible device.

27. The method according to claim 21, further comprising: adjusting the volume levels through the use of voltage doubling circuitry.

* * * * *